US005486668A

United States Patent [19]

Erickson

[11] Patent Number: 5,486,668

[45] Date of Patent: Jan. 23, 1996

[54] OPERATING MECHANISM FOR A MANUALLY OPERATED LOAD BREAK SWITCH

[75] Inventor: James A. Erickson, Crystal Lake, Ill.

[73] Assignee: Boltswitch, Inc., Crystal Lake, Ill.

[21] Appl. No.: 254,375

[22] Filed: Jun. 6, 1994

[51] Int. Cl.[6] ..... H01H 5/10

[52] U.S. Cl. ..... 200/400; 200/446; 74/2

[58] Field of Search ..... 200/446, 400, 200/401; 74/2

[56] References Cited

U.S. PATENT DOCUMENTS

| | | | |
|---|---|---|---|
| 3,213,247 | 10/1965 | Stene . | |
| 3,359,464 | 12/1967 | Henderson . | |
| 3,522,401 | 9/1967 | Stene . | |
| 3,582,595 | 6/1971 | Stene . | |
| 3,911,240 | 10/1975 | Henderson et al. . | |
| 5,053,590 | 10/1991 | Vierling | 200/400 X |
| 5,276,288 | 1/1994 | Erickson et al. . | |

OTHER PUBLICATIONS

Boltswitch Brochure "Bolt Pressure Contact Switches Series VL"—Bulletin 105 (no date).

*Primary Examiner*—Renee S. Luebke

*Attorney, Agent, or Firm*—Dorn, McEachran, Jambor & Keating

[57] ABSTRACT

An operating mechanism for a manually operated load break switch having an over center spring drive moved by an operating handle to open and close the switch. The operating mechanism includes a shaft rotatable by the operating handle, a follower rotatably mounted on the shaft, an elongated forked plate pivotally mounted intermediate its length to the follower at a location radially outwardly of the shaft, an operating lever for the switch pivotally mounted on the shaft and movable by engagement with the follower and a driver affixed to the shaft for rotation therewith and positioned to engage and rotate the follower and the forked plate. An over center spring drive is pivotally connected to the forked plate at a location radially outwardly of the pivotal mounting of the forked plate to the follower. This mechanism permits the over center spring drive to be moved between fully closed and fully opened conditions of the switch by rotation of the operating handle while preventing alignment of the shaft, the pivotal mounting of the forked plate to the follower and the over center spring drive pivotal mounting to the forked plate when the spring drive reaches its fully compressed condition.

8 Claims, 4 Drawing Sheets

OPERATING MECHANISM FOR A MANUALLY OPERATED LOAD BREAK SWITCH

BACKGROUND OF THE INVENTION

This invention relates to an operating mechanism for a manually operated bolted pressure contact switch of the type actuated by an over center spring drive in which the operating mechanism eliminates "hang up" of the switch contacts by preventing the spring drive from stopping in a fully compressed "dead center" position.

Fused bolted contact switches are frequently used in service entrance equipment and other relatively high current applications; typically multi-pole switches of this kind may require interruption of currents of the order of 400 to 80,000 amperes. It is critically important that the contacts of these switches be opened and closed rapidly to minimize arcing and thus avoid pitting and deterioration of the switch contacts. Because of the high currents handled by the switch contacts, they must not "hang up" in an intermediate position between fully open and fully closed or the contacts of the switch may be welded to each other by the flow of current.

The "hang up" of the switch contacts can occur when the over center spring drive hesitates or stops in a "dead center" position in which the drive spring is fully compressed during either opening or closing of the switch contacts. This unsafe condition can be brought about either unintentionally by a careless or inexperienced operator or deliberately by a thrill seeking or a malevolent operator.

Prior attempts to eliminate the dead centering of the spring drive have been concerned with modifications of the pivotal connection between the follower of the operating mechanism and the rod of the over center spring drive. An angled (non-symmetrical) elongated slot has been provided in the follower to receive a pivot pin connected to the spring drive rod so that as the spring drive reaches its "dead center" position (the fully compressed position of its spring) during opening of the switch contacts, the expanding spring force will shift the pivot pin in the angled slot past the "dead center" position of the spring drive. Unfortunately, the same result is not achieved with this prior construction during the closing of the spring contacts because the non-symmetrical angle of the elongated slot does not permit the expanding spring force to shift the pivot pin through the "dead center" position of the spring drive. This prior construction has not been entirely satisfactory for the additional reason that considerable wear can occur to the pivot pin as it moves in this angled slot, thus necessitating increased maintenance costs.

SUMMARY OF THE INVENTION

Accordingly, it is a principal object of this invention to provide an operating mechanism for a manually operated bolted pressure contact switch of the type actuated by an over center spring drive which prevents the spring drive from stopping in a "dead center" position in which its spring is fully compressed during either opening or closing of the switch contacts.

A specific object of the invention is an operating mechanism for a manually operated bolted pressure contact switch of the type actuated by an over center spring drive which prevents the spring drive from stopping in a "dead center" and fully compressed position during closing of the switch contacts.

Another specific object of the invention is an operating mechanism for a manually operated bolted pressure contact switch of the type actuated by an over center spring drive in which the over center spring drive is connected to the follower member by a plate which is mounted to rotate relative to the follower member with the plate and follower member being engageable and disengageable with the spring drive to provide a lost motion movement by the over center spring in advance of its "dead center", fully compressed position of the spring.

Yet another specific object of the invention is an operating mechanism for a manually operated bolted pressure contact switch of the type actuated by an over center spring drive in which the spring drive is pivotally connected to a plate which in turn is mounted so that the plate can pivot relative to the follower assembly.

Still another specific object of the invention is an operating mechanism for a manually operated bolted pressure contact switch of the type actuated by an over center spring drive in which the spring drive is moved by the actuating handle driver before the follower of the operating mechanism is rotated to thus prevent the spring drive from becoming fully compressed before it travels through a "dead center" position.

Accordingly, the invention relates to an operating mechanism for a manually operated load break switch having an over center spring drive moved by an operating handle to open and close the switch. The operating mechanism includes a shaft rotatable by the operating handle. A driver is affixed to the shaft for rotation therewith. A follower is rotatably mounted on the shaft and is rotated by engagement with the driver. An elongated forked plate is mounted on the shaft and is pivotally mounted intermediate its length to the follower at a location radially outwardly of the shaft. An operating lever for the switch is pivotally mounted on the shaft and is movable by engagement with the follower. An over center spring drive is pivotally connected to the forked plate at a location radially outwardly of the pivotal mounting of the forked plate to the follower. Means are provided to move the over center spring drive between fully closed and fully open conditions of the switch by rotation of the operating handle without aligning the shaft, the forked plate pivotal mounting to the follower and the over center drive spring pivotal mounting to the forked plate when the spring drive reaches its fully compressed condition.

Other and further objects of the invention may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENTS

Figure 1:
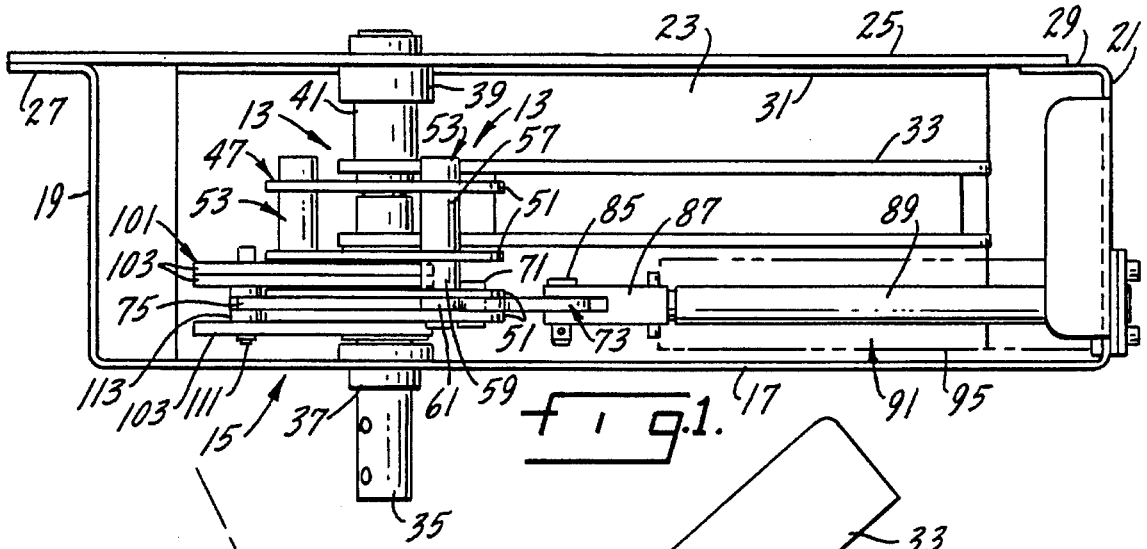
FIG. 1 is a top plan view of the switch operator of this invention with some parts shown in phantom lines and others omitted for clarity of illustration and showing the operating mechanism with the spring drive in its fully compressed condition.

The switch operating mechanism 13 of this invention is shown in a partial top plan view in FIG. 1 and in various positions of movement in FIGS. 2 through 12 of the drawings. This mechanism 13 is intended for opening and closing the movable contacts of a manually operated load break pressure contact switch. Typical load break pressure contact switches are shown in U.S. Pat. Nos. 3,213,247 and 3,522,401 (both issued to Stene). The disclosures of said patents are incorporated by reference into this specification. The present invention is not directed to the switch structure per se, but pertains to the operating mechanism 13 that is incorporated in a manually operated load break switch and is utilized to open and close the contacts of the switch. The invention should not be construed as limited to incorporation in or for use with the particular load break switches of U.S. Pat. Nos. 3,213,247 and 3,522,401, both of which are merely illustrative of a number of different configurations of switches in which the invention of this specification may be incorporated or may be used.

The switch operating mechanism 13, shown most fully in FIG. 1 of the drawings, is installed in an open top metal housing 15 typically having a front wall 17, end walls 19 and 21, a partial bottom wall 23 and a back wall 25. The front, end and bottom walls are formed integrally from a single sheet of metal cut and bent to the desired shape. The end and bottom walls are fastened to the rear wall using bolts and nuts (not shown) which extend through flanges 27, 29 and 31 formed integrally with the end and bottom walls, respectively.

A typical load break pressure contact switch, such as those shown and described in U.S. Pat. Nos. 3,213,247 and 3,522,401, has movable switch contacts and fixed switch contacts with an actuating bar that extends transversely of the switch contacts and is connected to the movable contacts by a linkage so that pivotal movement of the actuating bar drives the movable contacts into and out of engagement with the fixed contacts. The actuating bar is connected to a generally vertically directed operating rod by means of a pivotal connection. Conventionally, the operating rod is pivotally connected to the distal end of an operating lever 33 that is part of an operating mechanism 13 of this invention. The pivotal connection of the operating rod to the operating lever 33 has been omitted from the drawings of this specification for clarity of illustration.

The operating lever 33, which is of U-shaped transverse cross section, is pivotally mounted on a shaft 35 which extends through the housing 15 from front to rear. The shaft is journalled in bearing sleeves 37 and 39 mounted respectively in the front wall 17 and rear wall 25 of the housing. A bushing 41 encircles the shaft 35 between the operating lever 33 and the bearing sleeve 39 to position the operating lever along the shaft 35. A flatted portion 43 of the shaft 35 extends outwardly beyond the front wall 17 of the housing 15 to attach to an operating handle which is depicted in the drawings for clarity of illustration by a phantom line 45.

A follower 47 is rotatably mounted on the shaft 35 in an intermeshing relation with the operating lever 33. The follower 47 is formed of four identical, somewhat triangular shaped plates 51 each having a central circular opening (not shown) which fits over the shaft 35. These plates are held in spaced relationship to one another by three cross members 53 each consisting of a headed fastener 55. Each cross member is located near an apex of the plates. Bushings 57, 59 and 61 of varying lengths telescope over the fasteners to position the plates in predetermined spaced relationship to one another along the length of the shaft 35. The bushings provide rolling contact between the cross members 53 of the follower 47 and other elements of the switch operating mechanism 13 such as the operating lever 33. One of the sides of each of the somewhat triangular shaped plates 51 is slightly peaked at 63 and a circular hole 65 is formed in some plates near the peaks to receive a pivot pin 71.

The pivot pin 71 connects a forked flat plate 73 to the follower 47 with the forked flat plate located between a pair of closely spaced follower plates 51. The forked plate 73 includes a pair of tines 75 at one end thereof which tines extend outwardly of the follower 47 and straddle a cross member 53 of the follower. An arcuate opening 77 is formed in the forked plate between the tines 75 to receive and straddle a cross member 53 of the follower. The tines of the forked plate are formed with notched surfaces 79 at opposite ends of the arcuate opening 77 to engage a bushing 61 on a cross member 53.

The forked plate 73 fits over and receives the shaft 35 in an elongated slot 81 formed near the center of the forked plate. The elongated slot 81 permits the forked plate to move in an arc relative to the shaft 35 when pivoting about the pivot pin 71 connecting it to the follower 47. The end of the forked plate 73 located opposite to the tines is formed with a circular opening (not shown) which receives a pivot pin 85 to connect the forked plate to a yoke 87 of a drive rod 89 of a conventional spring drive 91. The opposite end 93 of the spring drive is pivotally connected to an end wall 21 of the housing 15 in a conventional manner. Also, as is conventional, the spring drive 91 includes a compression spring 95 which is shown only in phantom lines in the drawings for clarity of illustration.

A driver 101 is affixed to the shaft 35 for rotation therewith to engage and rotate both the follower 47 and the forked plate 73. The driver is formed by three somewhat L-shaped plates 103, each having a circular opening 105 formed in the upper legs 107 thereof to fit over and receive the shaft 35. Two of the somewhat L-shaped plates 103 abut each other and are located between plates 51 of the follower 47. The third L-shaped plate 103 is located laterally of the follower 47. The lower legs 109 of the L-shaped plates 103 are connected by a cross member 111 which includes a bushing 113 encircling a threaded fastener. The cross member 111 is located radially outwardly of the follower 47 so as to engage the tines 75 of the forked plate 73.

The driver 101 is also formed with arcuate surfaces 117 located on the L-shaped plates at the junction of the upper and lower legs 107 and 109. The arcuate surfaces 117 are positioned to engage a bushing 59 of a cross member 53 of the follower 47 to thereby rotate the follower.

Figure 2:
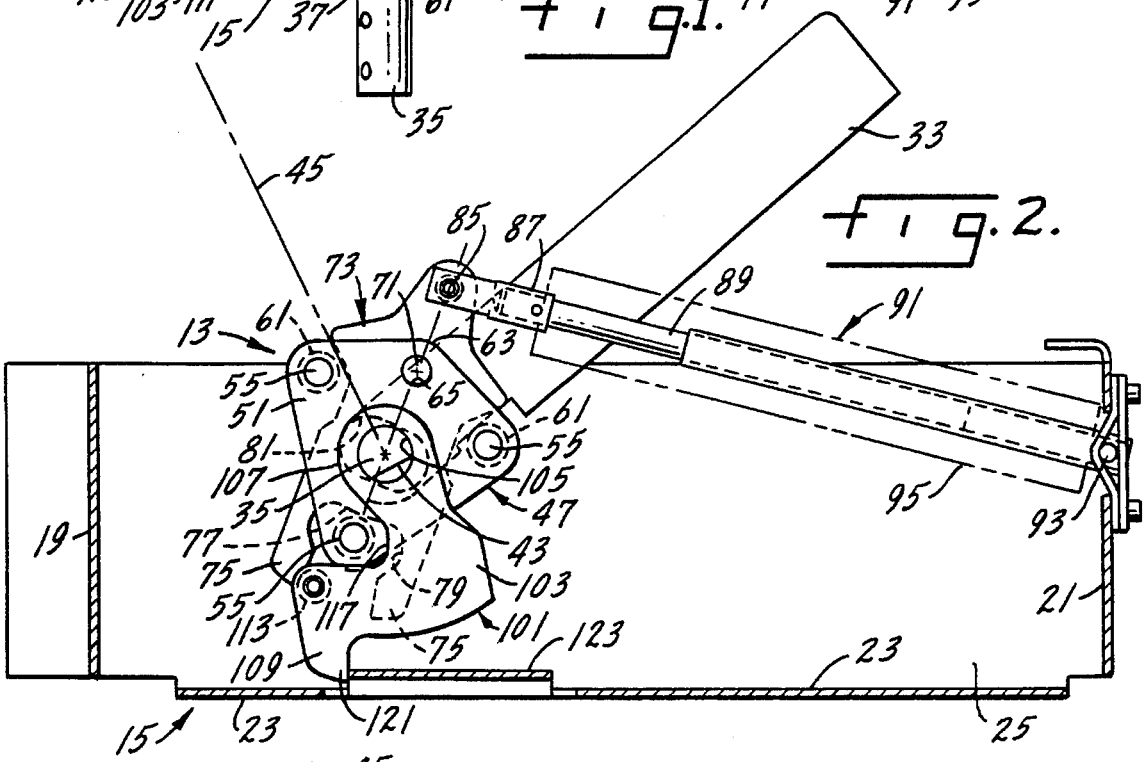
FIG. 2 is a side elevational view of the mechanism of FIG. 1 with some parts shown in cross section, others in phantom lines and still others omitted for clarity of illustration and showing the mechanism in the fully closed position of the switch.
Figure 12:
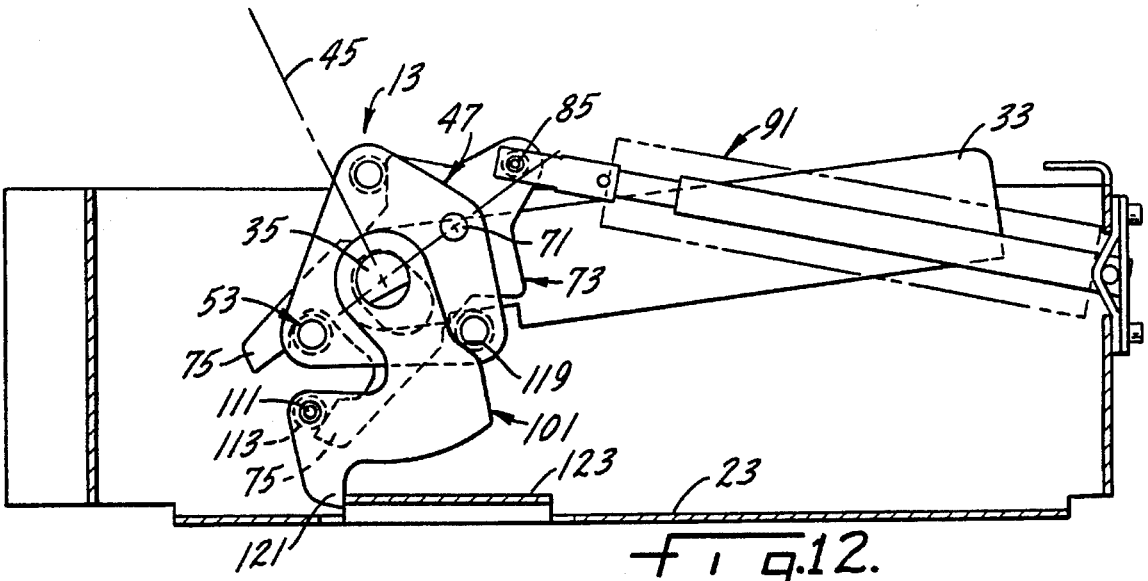
FIG. 12 is a view similar to FIG. 11 but showing the mechanism approaching the fully closed position of the switch.

Additionally, the plates 103 of the driver 101 are formed with inclined surfaces 119 which are positioned to engage a bushing 59 of a follower plate cross member 53 to rotate the follower plate in the opposite direction of rotation, especially during opening of the switch. A hook 121 is formed by surfaces on the L-shaped plates 103. As shown in FIGS. 2 and 12 of the drawings, the hook engages a bent up portion 123 of the bottom wall 23 of the housing to limit opening rotation of the follower 47.

The use, operation and function of this operation are as follows. The operating mechanism 13 of this invention is shown in FIG. 2 in the position it assumes when the contacts of the load break switch are in their closed positions. With the switch contacts fully closed, the spring drive 91 is in its fully extended position or at least as fully extended as permitted because of the engagement of the hook 121 of the driver 101 with the bent up portion 123 of the bottom wall 23 of the housing. The stop provided by engagement of the hook 121 of the driver 101 and bent up portion 123 is not essential to this invention and can be omitted if desired, which omission would allow the drive rod 89 of the spring drive to extend to its limit under the influence of the expanding spring 95. It should be noted that the shaft 35, the pivot pin 71 which attaches the forked plate 73 to the follower 47 and the pivot pin 85 of the spring drive 91 may be in alignment in this position of the operating mechanism. However, if the drive rod 89 is extended farther than the position shown in FIG. 2, it is possible that the shaft and the pivot pins 71 and 85 may not be aligned but will have to move through alignment during the opening of the switch contacts.

Figure 3:
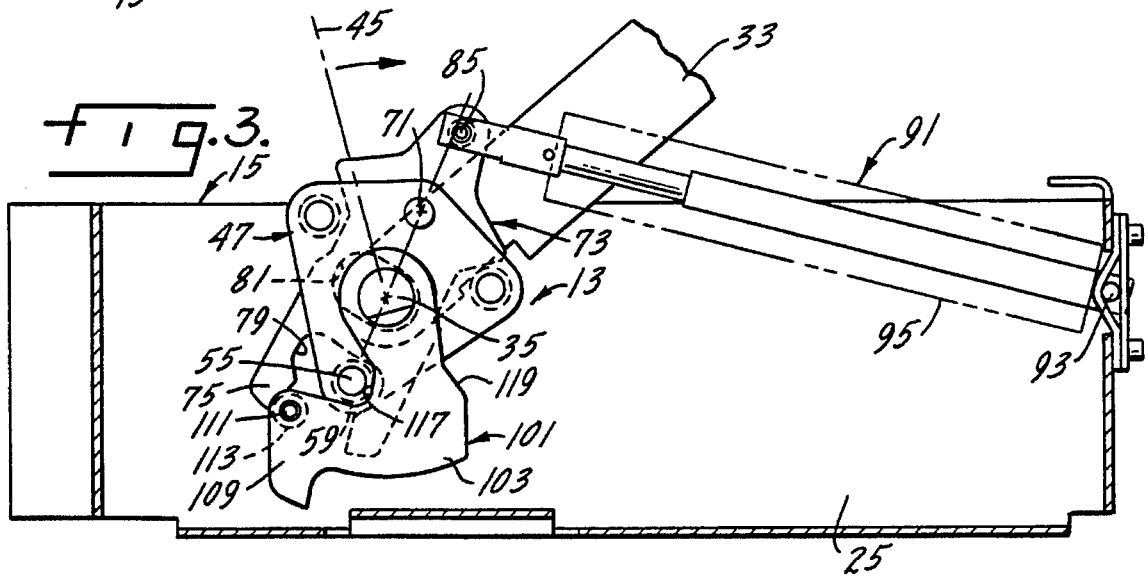
FIG. 3 is a view similar to FIG. 3 but showing the mechanism being moved towards a switch open position.

To open the switch contacts, the operating handle indicated by the phantom line 45 is rotated slightly in a clockwise direction as shown by the arrow in FIG. 3 of the drawings to thereby rotate the shaft 35 and its affixed driver 101 in a clockwise direction also as viewed in FIG. 3. The bushing 113 of the cross member 111 of the driver 101 engages a tine 75 of the forked plate 73 and rotation of the driver rotates the forked plate relative to the follower 47 about the pivot pin 71. The forked plate 73 is able to swing relative to the shaft 35 because the elongated slot 81 provides clearance for the shaft. Rotation of the forked plate about its pivotal connection 71 to the follower 47 causes the drive rod pivotal connection 85 to the forked plate 73 to move in a clockwise direction as viewed in FIG. 3, thereby moving the pivotal connection 85 out of alignment with the pivot pin 71 and the shaft 35 and ahead of the pin 71 in the clockwise direction of rotation. At the same time, the arcuate surfaces 117 of the driver 101 are moved into engagement with a bushing of a cross member 53 of the follower 47, but the follower 47 has not as yet been rotated.

Figure 4:
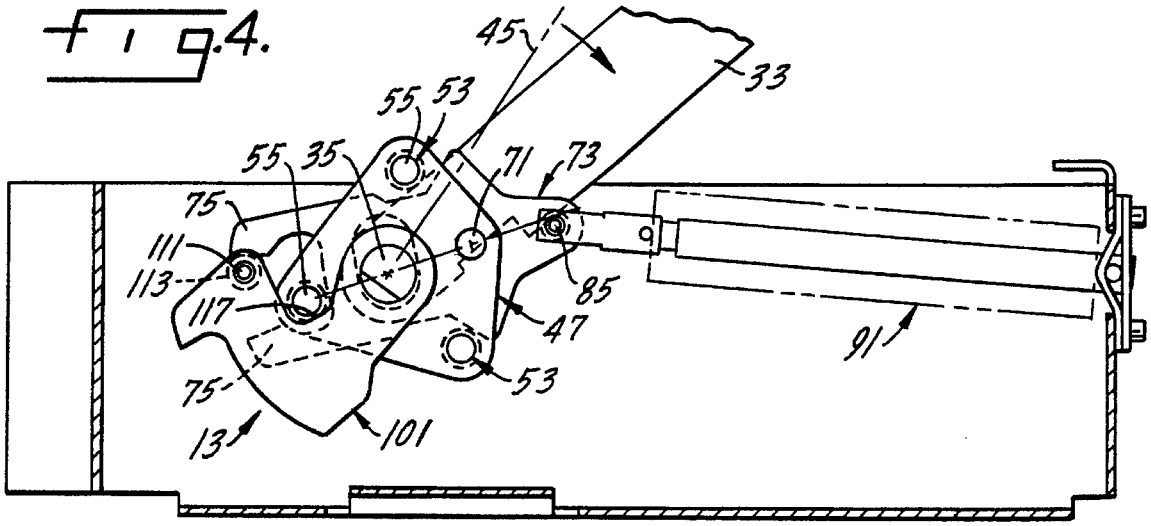
FIG. 4 is a view similar to FIG. 3 but showing the operating mechanism in a farther moved position towards a switch open position.

As the operator continues to rotate the operating handle indicated by the phantom line 45 in a clockwise direction as indicated by the arrow to the position shown in. FIG. 4 of the drawings, the driver 101 will rotate the forked plate 73 in a clockwise direction as viewed in the drawings due to engagement of the cross member 111 of the driver with a tine 75 of the forked plate 73. At the same time, the bight portion 117 of the driver is engaging a cross member 53 of the follower 47 to also rotate the follower in a clockwise direction. Rotation of the follower 47 also rotates the pivot pin 71 connecting the forked plate 73 to the follower. However, as can be seen in FIG. 4, the pivot pin 85 connecting the spring drive 91 to the forked plate 73 stays ahead of the pivot pin 71 in a clockwise direction of rotation thus preventing alignment of the pivot pins 71 and 85 and the shaft 35. It should also be noted that another of the cross members 53 of the follower 47 is moved into engagement with the switch operating lever 33. It should also be noted that the drive spring 91 is not as yet in its "dead center", fully compressed condition.

Figure 5:
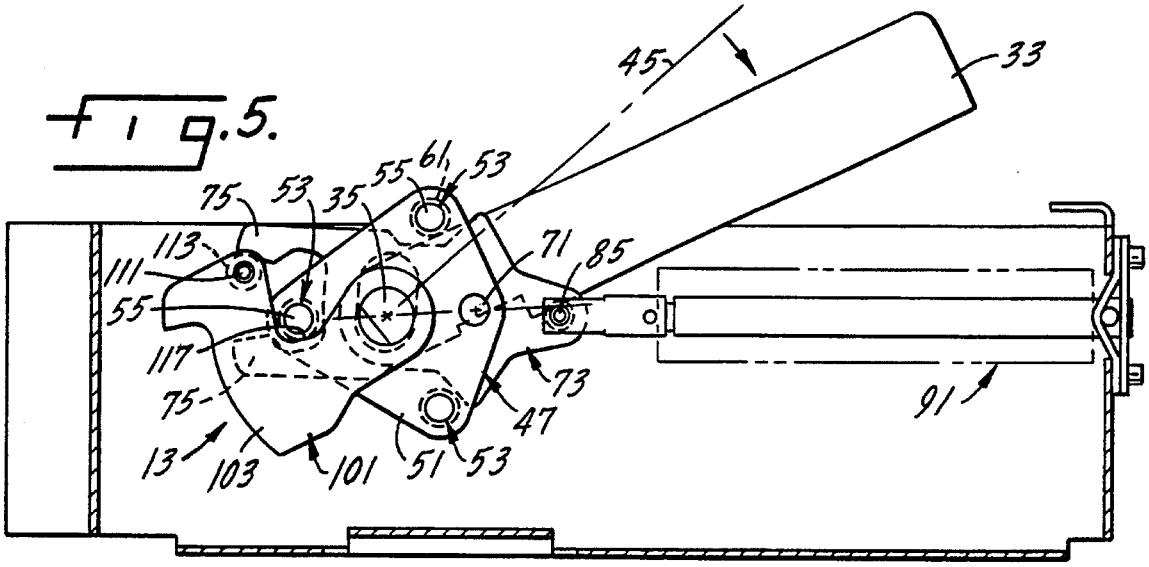
FIG. 5 is a view similar to FIG. 4 and showing the mechanism approaching the "dead center" position of the spring drive.

As the operator continues to rotate the operating handle indicated by the phantom line 45 in a clockwise direction, the spring drive 91 reaches its fully compressed condition shown in FIG. 5. The spring drive is driven to this condition by the forked plate 73 which is rotated by the driver 101. The follower 47 has also been rotated clockwise by engagement with the bight portion 117 of the driver with one of its cross members 53. However, the pivot pin 85 connecting the forked plate 73 and the spring drive 91 leads the pivot pin 71 in a clockwise direction of rotation thus setting up an unbalanced condition in which a moment arm between the pivot pins 85 and 71 causes the forked plate 73 to continue to rotate about its pivotal connection 71 to the follower 47 even though the driver 101 and follower 47 have stopped rotation. Thus, the forked plate 73 moves to the position shown in FIG. 6 where its clockwise rotation is stopped by engagement of its other tine 75 with a follower cross member 53. Thus, the spring drive 91 has rotated through a "dead center" alignment position between the shaft 35, pivot pin 71 and pivot 85 without any additional rotation of the shaft 35. Accordingly, it is impossible for the operator to "tease" or "hang up" the spring drive 91 in a "dead center" position.

Figure 6:
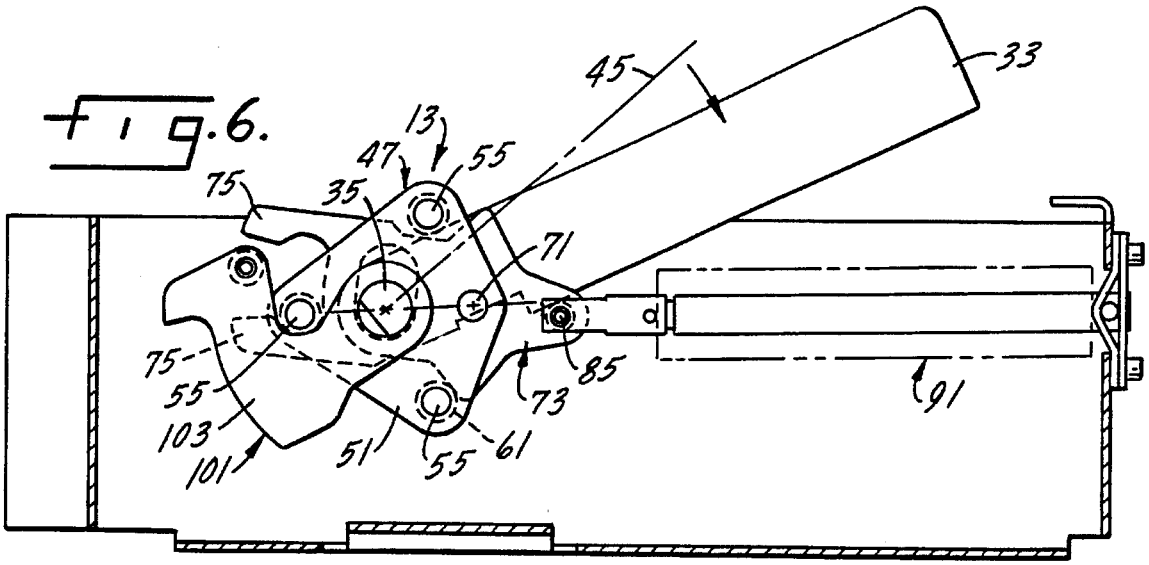
FIG. 6 is a view similar to FIG. 5 but showing the mechanism beyond the "dead center" position of the spring drive in a switch opening direction.
Figure 7:
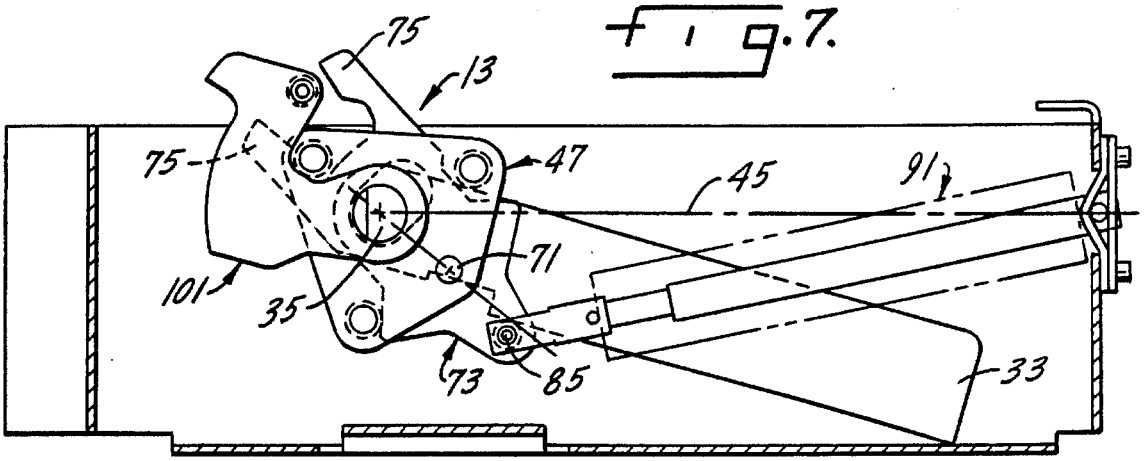
FIG. 7 is a view similar to FIG. 6 but showing the mechanism in the fully open position of the switch.

As soon as the spring drive 91 and its pivot pin 85 have reached the position shown in FIG. 6 of the drawings, the spring drive 91 will expand and will drive the forked plate 73, follower 47, driver 101 and switch operating lever 33 to the positions shown in FIG. 7 of the drawings where the switch contacts are in their fully opened positions. The rotational movement between the positions of FIGS. 6 and 7 will be extremely fast to avoid arcing or pitting of the switch contacts.

Figure 8:
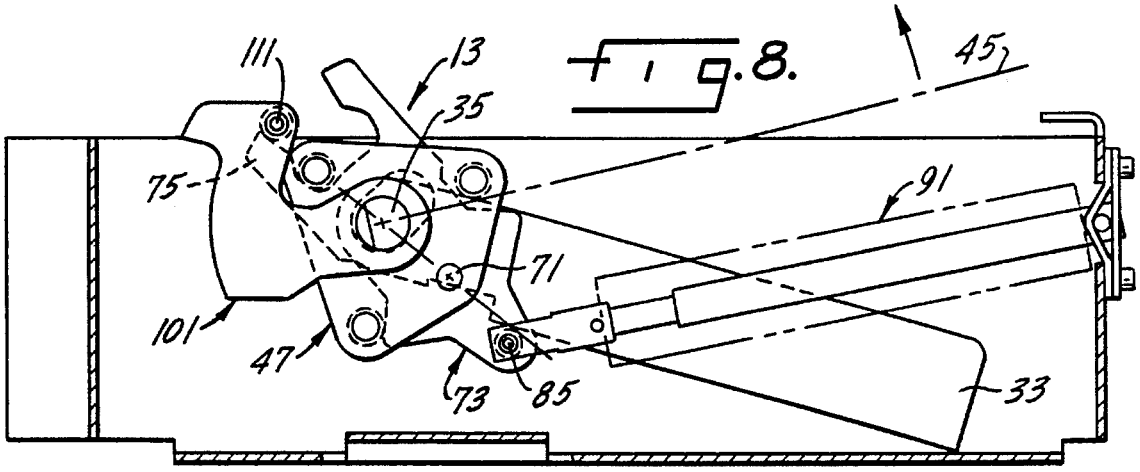
FIG. 8 is a view similar to FIG. 7 but showing the mechanism being moved towards the closed position of the switch.

When it is desired to close the switch, the operator rotates the operating handle indicated by the phantom line 45 in a counterclockwise direction as shown by the arrow from its position shown in FIG. 7 to the position shown in FIG. 8. Rotation of the operating handle causes the shaft 35 and its affixed driver 101 to rotate its cross member 111 in a counterclockwise direction as viewed in the drawings into engagement with a tine 75 of the forked plate 73. The forked plate is rotated about its pivotal connection 71 with the follower 47 without rotating the follower 47. Rotation of the forked plate 73 also causes the pivotal connection 85 to the spring drive 91 to rotate in a counterclockwise direction compressing the spring drive 91.

Figure 9:
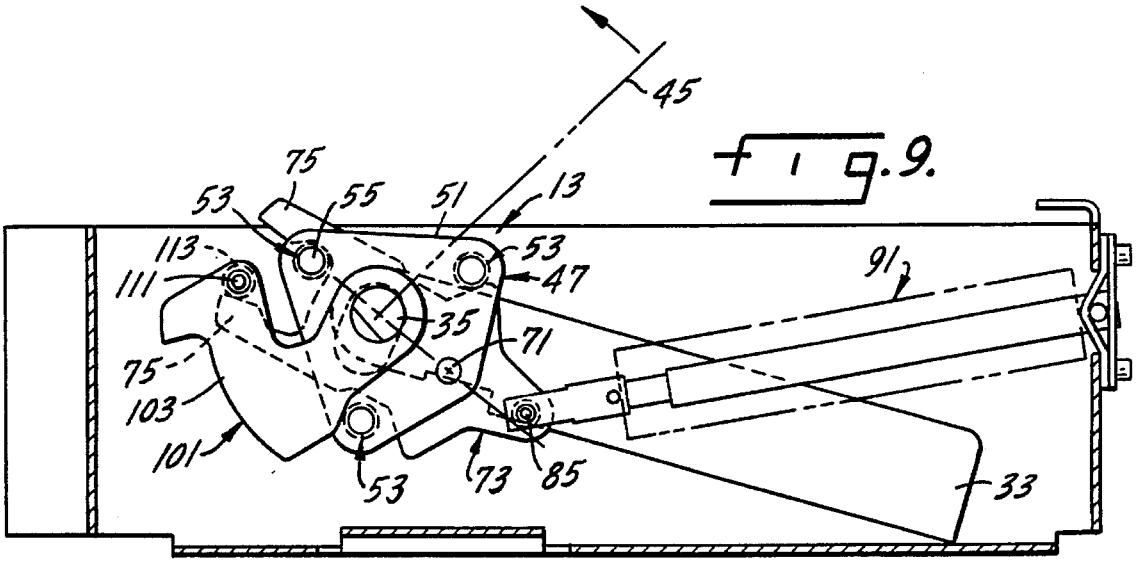
FIG. 9 is a view similar to FIG. 8 but showing the mechanism continuing movement towards the closed position of the switch.

Continued rotation of the operating handle indicated by the phantom line 45 in a counterclockwise direction as indicated by the arrow to the position shown in FIG. 9 of the drawings causes rotation of the forked plate 73 about its pivotal connection 71 to the follower 47 in a counterclockwise direction until the opposite tine 75 of the forked plate engages a cross member 53 of the follower. The rotation of the follower plate 73 in a counterclockwise direction has rotated the pivotal connection 85 between the forked plate and the spring drive 91 in a counterclockwise direction in such a manner that the pivot pin 85 of the spring drive 91 leads the pivot pin 71 in a counterclockwise direction as the spring drive 91 is being compressed.

Figure 10:
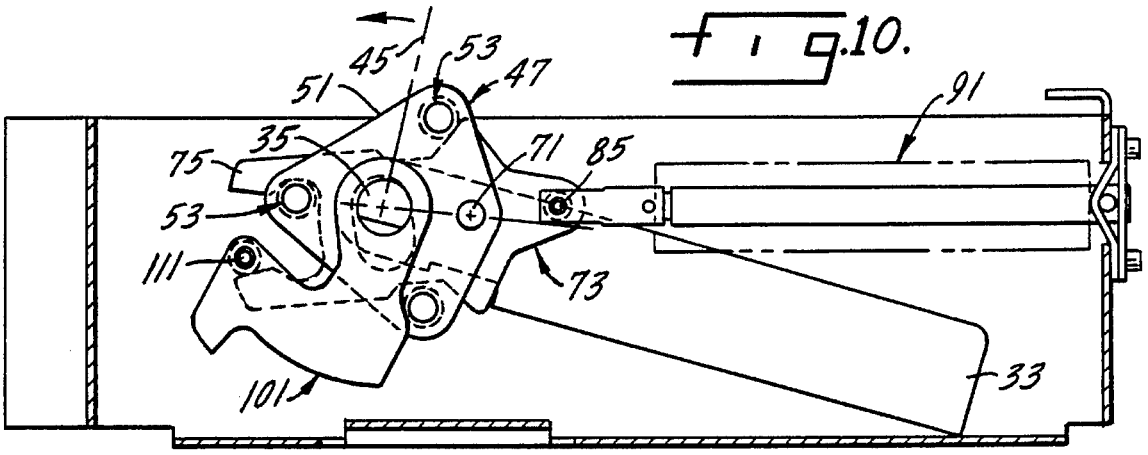
FIG. 10 is a view similar to FIG. 9 showing the mechanism continuing movement in a switch closing direction with the drive spring in its position of maximum compression.
Figure 11:
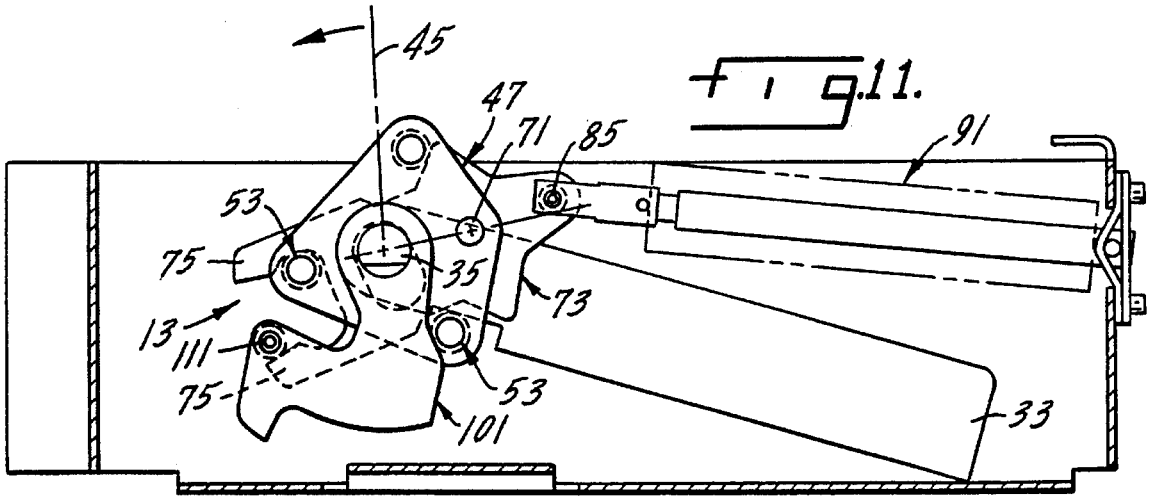
FIG. 11 is a view similar to FIG. 10 but showing the mechanism continuing movement towards the fully closed position of the switch.

Continued rotation of the operating lever indicated by the phantom line 45 to the position shown in FIG. 10 of the drawings will rotate the forked plate 73 and the follower 47 in a counterclockwise direction to move the drive spring 91 to its fully compressed position. However, in this position of rotation, the pivot pin 85 of the spring drive 91 connected to the forked plate 73 will be rotationally ahead of and not in alignment with the forked plate pivot pin 71 connecting the forked plate to the follower 47 and the shaft 35. Thus, when the spring drive 91 is fully compressed and before the operating lever 33 is caused to rotate in a counterclockwise direction to close the switch contacts, the operating mechanism 13 is already beyond any rotational position in which it could be hung up in a "dead center" position. Accordingly, as seen in FIG. 11 of the drawings, expansion of the spring drive 91 will cause rotation of the forked plate 73, the follower 47 and the operating handle, indicated by the phantom line 45, to the position shown in FIG. 11 of the drawings. When the follower plate 47 reaches the position shown in FIG. 11, one of its cross members 53 will engage the operating lever 33 to quickly move the operating lever in a counterclockwise direction to the intermediate position shown in FIG. 12. The expanding force of the spring drive 91 will cause the operating lever, forked plate and follower to move to their fully open positions which are shown in FIG. 2 of the drawings. Even though the hook 121 of the driver 101 engages the bent up portion 123 of the base 23 to stop rotation of the drive member and the operating handle, the forked plate and the follower will continue to rotate until one of the tines 75 of the forked plate engages the cross member 111 of the driver to end rotation of the follower and the forked plate. In the rotational position of FIG. 2 of the drawings, the operating lever 33 will be in its fully upright position and the contacts of the switch will be fully closed.

I claim:

1. An operating mechanism for a manually operated load break switch having an over center spring drive moved by an operating handle to open and close the switch, said operating mechanism including:

a shaft rotatable by said operating handle, a follower rotatably mounted on said shaft, an elongated forked plate pivotally mounted intermediate its length to said follower at a location radially outwardly of said shaft, an operating lever for said switch pivotally mounted on said shaft and movable by engagement with said follower, a driver affixed to said shaft for rotation therewith and positioned to engage and rotate said follower and said forked plate, an over center spring drive pivotally connected to said forked plate at a location radially outwardly of said pivotal mounting of said forked plate to said follower, and means to move said over center spring drive between fully closed and fully opened conditions of said switch by rotation of said operating handle while preventing alignment of said shaft, said pivotal mounting of the forked plate to said follower and said over center spring drive pivotal mounting to said forked plate when said spring drive is in its fully compressed condition.

2. The operating mechanism of claim 1 in which said driver is positioned to engage and rotate said forked plate independently of said follower.

3. The operating mechanism of claim 1 in which said driver is positioned to engage and rotate said follower independently of said elongated forked plate.

4. The operating mechanism of claim 1 in which said elongated forked plate is mounted to straddle said shaft.

5. The operating mechanism of claim 1 in which said means to move said over center spring drive between fully closed and fully opened conditions of said switch by rotation of said operating handle while preventing alignment of said shaft, said pivotal mounting of the forked plate to said follower and said over center spring drive pivotal mounting to said forked plate when said spring drive is in its fully compressed condition includes means to rotate the pivotal mounting of said spring drive to said forked plate ahead of said pivotal mounting of said forked plate to said follower.

6. An operating mechanism for a manually operated load break switch which is opened and closed by rotation of an operating handle which charges and discharges an over center spring drive, said operating mechanism including:

a shaft attached to said operating handle for rotation therewith, a follower rotatably mounted on said shaft, an elongated forked plate pivotally mounted intermediate its length to said follower at a location positioned radially outwardly of said shaft with said forked plate arranged to receive said shaft and to rotate in an arc about said pivotal mounting relative to said shaft, means to pivotally connect said elongated forked plate to an over center spring drive of said load break switch at a location radially outwardly of said pivotal mounting of said forked plate to said follower, and means to move said pivotal connection of said forked plate to said over center spring drive in the direction of rotation of said shaft in advance of the rotation of said pivotal mounting of said forked plate to said follower to prevent alignment of said shaft, said pivotal mounting of said forked plate to said follower and said pivotal mounting of said forked plate to said over center spring drive when said spring drive is rotated to its fully charged condition.

7. The operating mechanism of claim 6 in which said means to move said pivotal connection of said forked plate to said over center spring drive in the direction of rotation of said shaft includes:

a driver affixed to said shaft and adapted to engage said elongated forked plate and said follower upon rotation of said shaft, said driver, said elongated forked shaft and said follower being rotationally positioned relative to said shaft so that upon opening and closing rotation of said shaft said driver first engages said elongated forked plate and then engages said follower.

8. The operating mechanism of claim 7 in which said elongated forked plate is mounted for continued rotation out of contact with said driver in the direction of rotation of said shaft under the influence of said spring drive.

* * * * *